US005108224A

United States Patent [19]

Cabaniss et al.

[11] Patent Number: 5,108,224

[45] Date of Patent: Apr. 28, 1992

[54] SILT CONTROL FABRIC

[75] Inventors: Thomas G. Cabaniss, Smyrna; Mark B. Williams, Marietta, both of Ga.

[73] Assignee: Amoco Corporation, Chicago, Ill.

[21] Appl. No.: 627,029

[22] Filed: Dec. 13, 1990

Related U.S. Application Data

[63] Continuation of Ser. No. 401,993, Sep. 1, 1989, abandoned.

[51] Int. Cl.[5] ..... E02B 11/00

[52] U.S. Cl. ..... 405/52; 405/15; 405/21; 405/258; 139/426 R

[58] Field of Search ..... 405/36, 52, 258, 267, 405/109, 15, 16, 43, 45; 139/426 R

[56] References Cited

U.S. PATENT DOCUMENTS

| | | | |
|---|---|---|---|
| 1,997,132 | 4/1935 | Collorio | 405/109 |
| 3,540,587 | 11/1970 | Dawbarn | 256/12.5 X |
| 3,930,091 | 12/1975 | Lewis et al. | 139/436 R X |
| 4,368,234 | 1/1983 | Palmer et al. | 139/426 R X |
| 4,815,499 | 3/1989 | Johnson | 139/383 H |
| 4,830,907 | 5/1989 | Sawyer et al. | 139/426 R X |
| 4,865,906 | 9/1989 | Smith | 139/426 R X |

*Primary Examiner*—Dennis L. Taylor

*Attorney, Agent, or Firm*—William E. Murray; William H. Magidson; Robert J. Wagner

[57] ABSTRACT

A woven silt control fabric comprising substantially flat yarns woven with substantially round monofilament yarns, wherein the flat yarns are compacted, is capable of high water, flow capacity while achieving high soil retention. Preferably, the flat and monofilament yarns are made from substantially polypropylene and the flat yarns are compacted to about one hundred to about one hundred twenty percent coverage.

5 Claims, 3 Drawing Sheets

PRIOR ART

SILT CONTROL FABRIC

This is a continuation of application Ser. No. 401,993, filed Sept. 1, 1989 now abandoned.

FIELD OF THE INVENTION

This invention relates to a woven silt control fabric used to prevent soil or sand run-off from a land site due to water flow.

BACKGROUND OF THE INVENTION

Silt and soil erosion control methods are employed to prevent soil and sand run-off from a land site caused by water, such as that resulting from heavy rainfall. These control methods are particularly important to the building and road construction industry, and generally involve use of some form of a barrier around the site to impede silt, soil and sand run-off while permitting water drainage from the site.

The barrier used in these control methods sometimes is in the form of a fence, such as disclosed in U.S. Pat. No. 4,671,495, where the fence is built from slats that are attached to posts and rotate partially around the posts, or in U.S. Pat. No. 3,426,536, where the fence is built from pliable strips and posts, with the strips alternately plaited through the posts perpendicular to the ground.

Fences have also been used for snow control purposes. U.S. Pat. No. 514,999 describes a metal snow fence of broad metal bands interwoven with a metal thread. U.S. Pat. No. 3,672,638 describes a snow fence made from a wire fabric containing warp and weft wires. The warp wires each have a diameter of between 0.011 and 0.018 inches, and are finer than the weft wires. The weft wires extend perpendicular to the warp wires, having a diameter of between 0.018 and 0.047 inches and a weft density of 4 to 8 wires per inch. The fence fabric also has a plurality of slat portions in the warp direction that alternates with open portions. Within the slat portions, the warp density is between 15 and 40 wires per inch, being greater at the upper and lower edge to provide selvage effects. In addition, to bind the wires, the fabric has a coating which encases the warp and weft wires but does not close the interstices within the slat portions.

Woven silt control fabrics using synthetic yarns have been used increasingly in recent years to prevent soil run-off from construction sites. Woven silt control fabrics are generally designed to have water flow capacity of about 20 or above gallons per minute per square foot of fabric (gal/min/ft$^2$), while retaining soil particles greater than 20 apparent opening size (AOS), also termed equivalent opening size (EOS). (Apparent opening size numbers correspond to U.S. sieve size; for example, a 20 AOS equals a 20 sieve and a 30 AOS equals a 30 sieve.) For example, two woven silt control fabrics sold by Amoco Fabrics & Fibers Company, and designated as Number 1380 and Number 2125 in a brochure entitled "WOVEN FABRIC SELECTION GUIDE," have water flow capacities, also called permitivities, of 30 and 15 gal/min/ft$^2$, respectively, while having an AOS of between 20 to 30 and between 30 to 50, respectively. The State of Georgia is a leading user of silt control fabric and the State of Georgia Department of Transportation silt control fence specifications, entitled Specification Section 171-"Temporary Silt Fence," published Nov. 4, 1988, specify a water flow capacity of 25 gal/min/ft$^2$ and an AOS of 30, and specify use of slit tape yarns in only one direction, either warp or fill.

Woven silt control fabrics have been made using various fabric design methods. First, yarns of substantially flat and rectangular cross-sections, sometimes called tape or ribbon yarns, have been used in silt control fabrics as both the warp and the fill yarns, which are woven together using a plain weave. The aforementioned Amoco Fabric No. 2125 is of this type. These fabrics have been used successfully for silt control, although the size of the openings in the fabric can be inconsistent because of the presence of flip turns (or folds) resulting occasionally from insertion of the weft yarns during the weaving process. Such fabrics thus cannot always retain all soil particles of a certain size, since the maximum opening size, which equals that resulting from the flip turns, may be too large.

A second fabric, available from Belton Industries, employs very wide, flat tape yarns in the warp and weft, which are woven together with a twill-type weave in a highly compacted fashion in each of the warp and weft. This fabric design is limited in that high water flow rates through the fabric concomitant with retention of small soil particles cannot be achieved with it.

Silt control fabrics also have been woven from tape yarns and either bulked continuous filament (BCF) yarns or spun yarns. The aforementioned Amoco Fabric No. 1380 is of this type using spun polypropylene yarns. Each of the BCF and spun yarns are relatively more expensive, making these fabrics significantly more expensive; they thus find use only in specialty applications or in applications with minimal requirements for fabric strength and lifetime, which permit use of second-quality BCF or spun yarns to lower fabric cost.

Various woven fabric constructions and yarn types have been used for applications other than silt control. For example, in the Amoco Fabrics and Fibers Company Brochure discussed previously, Fabric No. 1198, used for "Embankment/Erosion Control," is made with monofilament yarns in the warp and weft. The monofilament yarns in the warp of this fabric are shaped like narrow flat yarns, with a low "aspect ratio", which is used herein means the ratio of yarn width to yarn thickness. This fabric does not employ compaction of the warp yarns.

U.S. Pat. No. 4,590,121 describes a woven sail cloth with spaced fibrous yarns woven in one direction and spaced tapes at least four times wider than the yarns in a perpendicular direction. This sail cloth fabric is disclosed as having greatly reduced porosity and as having the advantage of being made with less loom time.

U.S. Pat. No. 3,317,366 describes a woven polyester fabric for carpet that consists of a warp of flat monofilaments and a fill of multifiber yarns. This backing is said to exhibit improved dimensional stability and avoid needle deflection in the tufting operation.

U.S. Pat. No. 3,252,484 describes a fabric adapted for adhering to a textile fabric when in contact with the textile fabric under application of heat and pressure. This adhesive fabric employs one series of yarns made by doubling thermoplastic yarns with non-thermoplastic yarns which are then woven with another series of non-thermoplastic yarns.

U.S. Pat. No. 3,540,587 describes a method for depositing particles by using a thermoplastic sheet make of strips of thermoplastic filaments, wherein the filaments are used as a reinforcement in at least two directions.

This fabric is disclosed as useful for beach erosion control.

U.S. Pat. No. 1,964,419 describes a porous textile fabric designed for filtration, which is made from a wide mesh base fabric. Threads are added in the warp direction which stay on one side of the fabric and are woven with added threads in the fill direction which stay on the opposite side of the fabric.

U.S. Pat. No. 1,659,680 describes a woven tire cord fabric, wherein the warp yarns are designed to lie flat and parallel throughout the warp, consisting of a set of relatively coarse cords as a warp and a relatively fine set of wefts, spaced at a distance equal to several diameters of the warps, which are interwoven by having each weft pass over one warp and then under several warps.

U.S. Pat. No. 904,350 describes a fabric for use in the body portion of bags or luggage consisting of a warp with flat strips and with warp threads lying parallel to the strips and between them, interwoven with weft threads which are either flat or round.

U.S. Pat. No. 3,283,788 describes a process for producing a textile fabric made from thermoplastic materials wherein split fibers lying in one direction are interlaced with threads, filaments or yarns lying in a transverse direction.

U.S. Pat. No. 4,421,439 describes a soil bearing fabric, for use in building on top of bad subsoils, made from a warp having straight warp yarns and binder warp yarns, with each straight warp yarn having a higher strength than the binder warp yarns. The warp contains 2–15 straight yarns and 2–15 binder yarns per centimeter of fabric. The fabric disclosed therein is not compacted in the warp and the straight warp yarns and binder warp yarns are disclosed as being formed by multifilament yarns, monofilament yarns, flat yarn or split fibers.

Great Britain Patent 811,108 describes a flexible material, for use as a belting material, made from a ribbed, reinforcing fabric covered with an elastomer. The reinforcing fabric is made with warp yarns having little crimp alternating with warp yarns having substantial crimp. The two example fabrics in this patent are disclosed as constructed with 24 ends and 15 and 16 picks, respectively. This fabric is not described as compacted in the warp or as using flat yarns.

U.S. Pat. No. 4,362,199, and its related patent Gr. Britain 1,591,091, describe a bulk storage bag made with a woven fabric which is strengthened and reinforced by adding different yarn threads to the fabric. These patents also discuss a technique sometimes referred to as "cramming," which is defined as increasing the number of warps of thread per unit length of that portion of fabric containing the added threads to at least 1.4 times the number of warps per unit length in the other portions of the fabric.

U.S. Pat. No. 4,207,937 describes a storage bag using a crammed fabric to add strength near the selvages in the fabric. Great Britain Patent 2,132,171A describes cramming in the warp of the bulk container fabric. European Patent Application 0212835, filed Jul. 14, 1986, describes cramming of the warp threads to provide reinforcing bands to add strength in such bulk container bags. U.S. Pat. No. 4,390,044 describes an apparatus for producing a fabric having crammed weft threads.

The existing woven silt control fabrics generally are not able to achieve relatively high water flow rates through the fabric while at the same time retaining relatively smaller soil particles. It is an object of this invention to provide an improved silt control fabric. It is another object to provide such a silt control fabric capable of high water flow rates and high soil retention. It is a further object to provide a silt control fabric having a longer life expectancy. It is yet another object to provide an inexpensive silt control fabric.

We have found that the objects of the invention can be achieved by providing a woven silt control fabric in which substantially flat tape yarns and substantially round monofilament yarns are woven in a particular construction to create a fabric substantially lacking in gaps or open spaces having angles of incidence substantially perpendicular to the plane of the fabric surface while having a plurality of substantially triangular shaped gaps having angles of incidence other than substantially perpendicular to the plane of the fabric surface.

SUMMARY OF THE INVENTION

The invention comprises a silt control fabric comprising a plurality of substantially flat yarns in one direction interwoven with a plurality of substantially round monofilament yarns in a substantially perpendicular direction to the flat yarns, wherein the flat yarns are compacted. In a preferred embodiment, the flat yarns are compacted to about one hundred to about one hundred twenty percent coverage. The fabric of the invention has excellent soil retention and high water flow capacity and therefore reduced water pressure on the fabric, resulting in longer fabric life.

DESCRIPTION OF THE PREFERRED EMBODIMENTS

Figure 1:
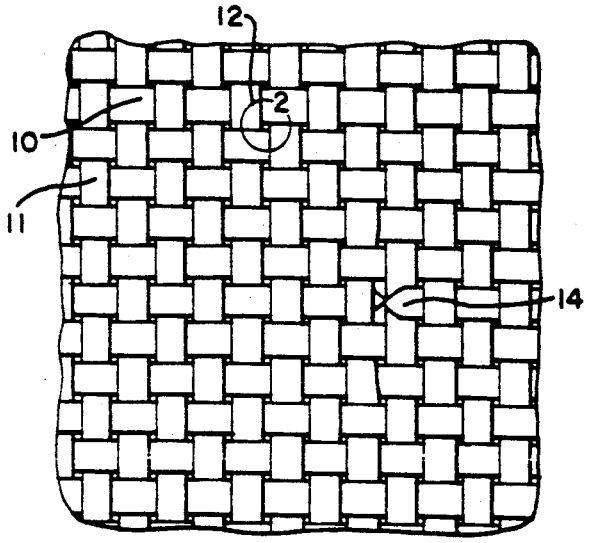
FIG. 1 is an overhead view of a silt control fabric of the prior art.
Figure 2:
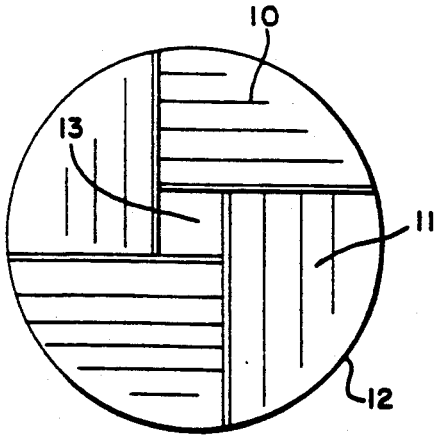
PRIOR ART FIG. 2
FIG. 2 is an enlarged view of a part of FIG. 1.

FIG. 1 is an overhead view of a prior art, woven silt control fabric constructed in a plain weave with both warp yarns 10 and weft yarns 11 made from flat tape yarns. Circle 12 encircles the intersection/overlay point 2 of one pair of warp yarns with one pair of weft yarns. FIG. 2 is a enlarged view of Circle 12 and shows opening or gap 13 in the fabric through which water and soil particles smaller than the opening can flow. Also seen in FIG. 1 is a twisted warp yarn 14, which is known as a flip turn. Flip turns occasionally result during the insertion of the weft yarns into the warp during the weaving process. The presence of flip turns in a silt control fabric results in different size openings than openings 13, and leads to variations in the fabric's water flow capacity and soil retention. When the fabric is installed substantially perpendicular to the ground in a silt control fence, the openings 13 in the fabric have an angle of incidence substantially perpendicular to the plane of the fabric surface and thus substantially parallel to the direction of water flow through the fabric, which disadvantageously facilitates soil particle flow through the fabric.

In contrast, the silt control fabric of the invention employs a weave of a plurality of flat yarns having a substantially flat surface, and preferably a rectangular cross section, in one direction, preferably as warp yarns, woven with a plurality of substantially round monofilament yarns, preferably as weft yarns, in a direction substantially perpendicular and preferably at right angles, to the direction of the flat yarns.

In addition, the flat yarns in the fabric of the invention are compacted. As used herein, "compacted" or "compaction" means greater than about one hundred percent (100%) yarn coverage in the direction substantially perpendicular to the direction of the monofilament yarns, which, for convenience, will hereafter be designated as in the direction of the warp. In other words, the warp yarns partially overlap each other and the percent compaction is a measure of the extent of overlapping in the warp. Yarn coverage is calculated for purposes herein, by multiplying the total number of the flat yarns present in one inch of fabric times the width, in mils, of the flat yarn, and dividing the product by 1000; this figure is then converted to a percentage (one mil equals one thousandth of an inch). In this coverage calculation method, one thousand mils equals one hundred percent coverage and all coverage above one thousand mils is compacted. An example of the coverage calculation is for a flat yarn 58 mils wide woven with 16 ends per inch:

$$\frac{16 \times 58}{1000} = .928 \times 100 = 92.8\% \text{ coverage.}$$

Figure 3:
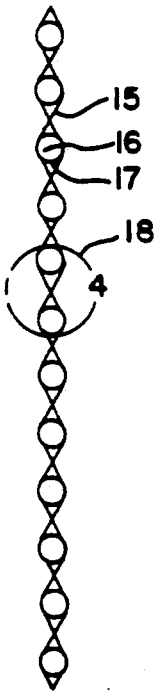
FIG. 3 is an end view of the fabric of the invention.
Figure 4:
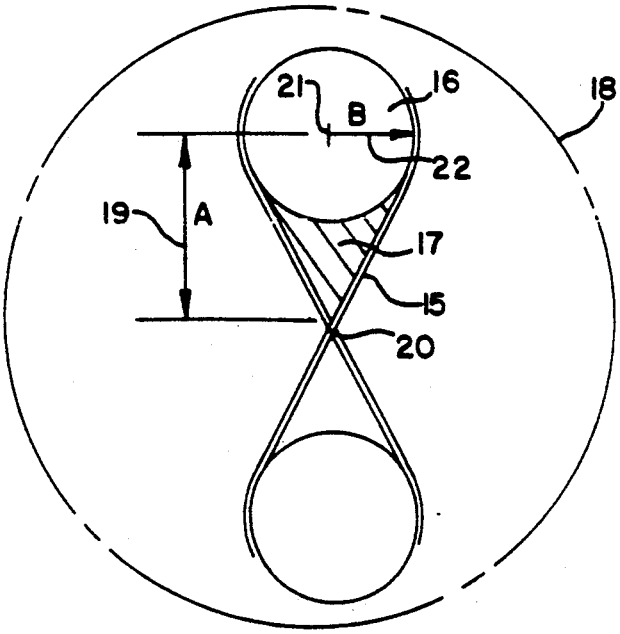
FIG. 4 is an enlarged view of a part of FIG. 3.

FIG. 3 is an end view of the fabric of the invention looking in a direction which parallels the length of the monofilament weft yarns. FIG. 3 shows the plurality of compacted flat yarns 15 interwoven with monofilament weft yarns 16. Circle 18 encircles one pair 4 of monofilament yarns 16 and illustrates openings or gaps in the fabric of the invention. In contrast to the roughly square-shaped openings 13 of the prior art fabric of FIG. 1, openings 17 in the fabric of the invention are roughly triangular in shape. FIG. 4 is an enlarged view of circle 18. Surface area of an opening in the fabric of the invention can be calculated from the formula:

$$\text{AREA} = AB - \tfrac{1}{2}(\pi B^2),$$

where A is distance 19 between cross-over point 20 of flat yarn 15 and center 21 of the monofilament yarn 16, and B is the radius 22 of monofilament yarn 16. The total surface area of the openings in the fabric of the invention is then calculated by multiplying total number of openings times the AREA determined with the above formula.

Besides the difference in shape of the openings in the fabric, when the silt control fabric of the invention is installed substantially vertically to the ground, the angle of incidence of the openings is not substantially perpendicular to the plane of the fabric surface nor parallel to the direction of water drainage. The flat yarns in the fabric of the invention thus essentially operate as a blind to soil particles, even for those smaller than the opening 17, while permitting high water flow rates through the fabric. The fabric of the invention therefore has the surprising advantage of having high water flow capacity and improved soil retention at the same time, compared to the prior art woven fabrics which achieve high flow only at the expense of soil retention.

Any weaving technique can be used to manufacture the silt control fabric of the invention. However, the fabric of the invention is preferably made using a conventional weaving method to produce a plain weave (1×1) fabric, since a fabric made with a weave other than a plain weave may lose its dimensional stability. In using this conventional method, it is preferred to use the flat tape yarns as the warp yarns and the monofilament yarns as the weft yarns, because using the flat yarn as the weft yarn can result in a number of flip turns. In the conventional method the flat yarns of the warp are placed horizontally side by side in a loom, with alternate yarns being separated by a system of frames. During each weave, the frames pull the alternate yarns vertically apart. Through this space is passed a mechanism, such as a shuttle, carrying the monofilament yarn, which moves across at high speed. The monofilament yarn is held straight under tension while the warp-holding frames change position, causing the flat yarns to be wrapped or crimped over and under the monofilament yarns.

In production of the fabric of the invention, the width of the flat yarns, the diameter of the monofilament yarns used in the weft and the number of ends or picks, i.e., the number of yarns present in each of the warp (ends) and the weft (picks) can be changed to produce silt control fabrics having variations in water flow capacity and in size of soil particle which can pass through the openings in the fabric. In designing the construction of a fabric of the invention, the formula set out previously is used to calculate the fabric opening size which will achieve retention of soil particles of a given size. The desired water flow capacity of a fabric is then used to calculate the number of yarn interlacings, which is where the openings in the fabric occur, per square inch of fabric required to achieve the desired water flow capacity. For example, a silt control fabric of the invention constructed to retain soil particles of 30 AOS can have a water flow rate of over 100 gallons per minute per square foot of fabric.

The flat tape yarns used in the warp are preferably flat yarns having a high aspect ratio, for example, such as slit film, tape yarns, which are made by forming a film of resin in the desired thickness and then slitting the film into flat yarns of the desired width. The flat yarns can also be made by extrusion of the yarn resin through a square or rectangularly shaped die size. However, extruded flat yarns are significantly more costly, in excess of 15% greater, than the preferred slit film yarns. In addition, extruded flat yarns generally have much lower aspect ratios than slit film flat yarns, resulting in the use of a larger end count of narrower flat yarns to produce the fabric of the invention. Thus flat yarns made from slit films of a desired synthetic resin are preferred because of their economy.

The preferred flat yarns have a width in the range of about 40 mils to about 60 mils, and preferably is about 50 mils wide. Flat yarns in this range are preferred because they can be woven in a compacted fashion using a relatively lower number of ends. The thickness of the tape yarns can be any convenient thickness and preferably is about two mils thick to have sufficient durability for repeated use. The aspect ratio of the flat yarns is preferably in the range of about 16:1 to about 36:1, because yarns of this size can be woven using the preferred end counts to produce a compacted warp.

The monofilament yarn used is preferably substantially round in shape, since monofilament yarns in this shape provide sufficient sized openings for water flow with good soil retention. The round monofilament yarns preferably have a diameter in the range of about 12 mils to about 16 mils, since fabrics according to the invention woven with yarns having diameters above 16 mils may not retain small soil particles and fabrics woven with yarns having diameters below 12 mils must have higher pick counts to have sufficient water flow capacity. More preferably, the monofilament yarns have a diameter of about 14 mils because fabrics made with this size yarn have higher water flow capacity.

Each of the flat tape yarns and the monofilament yarns can be of any synthetic or natural material having sufficient tensile strength to achieve sufficient woven tensile strength when made into flat or monofilament yarn, respectively. Additives, such as colorants or ultraviolet stabilizers can be present in the yarns if desired. Preferably, for durability the tape yarns and the monofilament yarns are made of a synthetic thermoplastic material such as polyester, polyaramid, acrylic polymers, polyolefin or blends or co-polymers thereof. More preferably the yarns are made substantially from a polyester or a polyolefin, and most preferably, are made substantially from polypropylene. Polypropylene yarns are most preferred because of their strength, toughness and low water absorption at relatively low cost. The flat yarns and the monofilament yarns can be made from the same or from different resins.

The fabric of the invention employs compaction of the flat yarns determined by the number of ends of warp yarn, wherein extent of the compaction of the flat yarns is greater than about 100 percent coverage because without compaction, insufficient soil retention can occur. The compaction can be as great as 160 percent coverage; however, high compaction increases weaving difficulty and increases fabric cost. The compaction of the warp yarns is preferably in the range of about 100 percent to about 120 percent coverage as fabrics in the range achieve excellent soil retention, and are made with relatively easy weaving. Most preferably the compaction is about 110 to about 120 percent coverage, because these fabrics have better soil retention than fabrics of the invention having compactions less than 110 percent coverage.

The fabric of the invention is preferably constructed so that the number of ends in the warp is in the range from about 20 per inch to about 32 per inch, because fabrics made having this end count range using flat yarns having a width of about 40 to about 60 mils are compacted in the warp. Most preferably the fabric is constructed with 24 ends per inch to achieve compaction within the most preferred range of compaction.

The weft in the fabric should have a number of picks in the range from about 11 per inch to about 16 per inch, to provide sufficient number of openings to obtain a water flow capacity above 30 gal/min/ft$^2$ and fabrics made with below about 11 picks per inch may not achieve sufficient soil retention. Preferably, the fabric has about 14 picks per inch since fabrics with this pick count have high water flow capacity.

The fabric of the invention is light in weight and generally will range in weight from about 3.0 oz/yd$^2$ to about 6.0 oz/yd$^2$. Preferably the fabric is less than 4.0 oz/yd$^2$ to hold down fabric cost. The fabric weight is in part due to the denier of the yarns used. The yarns of the fabric of the invention can be of any denier to produce yarns of sufficient tensile strength.

After weaving, the fabric can be subjected to additional treatments, such as calendering or heat treating, if desired. However, any coating of the fabric may affect its water permeability.

The fabric of the invention preferably meets the performance specifications set out in the following Table 1, which are the performance specifications set by the State of Georgia Dept. of Transportation for silt control fabric.

TABLE 1

| Property | Test Method | Requirement |
|---|---|---|
| Tensile Strength | ASTM D4632 Grab Test Method using 1 by 2 in. jaws and a travel rate of 12 inches per minute. | Warp-120 lbs. minimum Fill-100 lbs. minimum |
| Grab Elongation | ASTM D4632 Grab Test Method using 1 by 2 inch jaws and a travel rate of 12 inches per minute. | 40% maximum |
| AOS (Apparent Opening Size) | Corps of Engineers Guide ASTM D4751 Test. | 30 sieve maximum |
| Flow Rate | GHD 87 | 25 gal/min/ft$^2$ minimum |
| Ultraviolet | ASTM D4632 Grab Test, as above, after 300 hours in accordance with ASTM D4355, (80% of required minimal tensile strength). | 80 lbs minimum |
| Bursting Strength | ASTM D3786 Diaphragm Bursting Strength Tester | 175 psi minimum |

The fabric of the invention is capable of surprisingly high water flow rates while retaining relatively small particles below 30 AOS. The water flow capacity is preferably in the range of 90 gal/min/ft$^2$ to 120 gal/min/ft$^2$. More preferably, the fabric has a water flow capacity of at least 100 gallons per minute per square foot of fabric. The soil retention of the fabric preferably is above about 95% of all particles sized at or bigger than 30 AOS.

Figure 5:
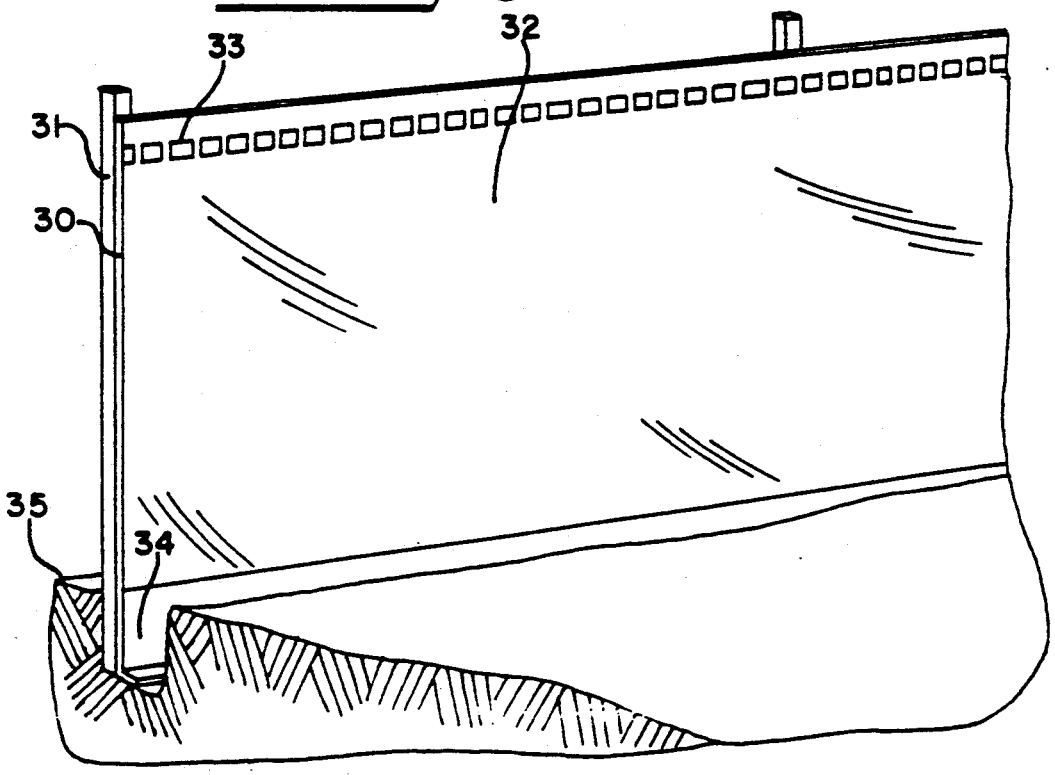
FIG. 5 is an illustration of the fabric of the invention in use.

FIG. 5 illustrates the slit control fabric of the invention installed at a land site. Fabric 30 is shown attached with any effective attachment means, such as staples or the drawstring attachment means 33 shown in FIG. 5, to any suitable support means 31, such as a post. The attachment means preferably comprises staples because of cost. Preferably the fabric is attached so that the flat yarns parallel the ground surface 35. The fence 32 comprising the fabric/support means is erected preferably substantially vertical to the ground, using any technique known to one skilled in the art which provides sufficient support to retain the fabric in place under actual conditions of use. Fence 32 is preferably installed in a trench 34 so that the lower edge of the fabric is below ground level 35, to prevent channelling of water and soil under the fabric.

In another embodiment of the invention, the fabric is constructed so that only a part of the fabric contains the compacted flat yarns with monofilament yarns. Fabric of this type, when used, is installed so that the compacted part of the fabric is next to the ground. This embodiment thus permits use of less costly construction, weave or yarns in the fabric part not adjacent the ground. For example, a fabric could be installed in a three-foot tall silt fence so that the bottom two feet of the fabric next to the ground contains the compacted warp.

EXAMPLES 1–8

Silt control fabrics according to the invention were woven on conventional Sulzer looms. The warp yarns were flat yarns made from polypropylene film made from a polypropylene resin having a melt flow rate of 3–4 grams per ten minutes and a density of 0.905 grams per cubic centimeter, were 2.3 mils thick, 43 mils wide and 525 denier and has an aspect ratio of 18.7/1. The weft yarns were substantially polypropylene, round monofilament yarns made from the same resin and were 16 mils diameter and 1150 denier. The fabrics were woven in a plain weave so that the warp had about 24 ends per inch across the fabric and the weft had about 12 picks per inch across the fabric. In each of the fabrics of Examples 1–8, the warp was compacted to 103.2%.

The properties of the fabrics were then tested, and the results are set out in Table 2.

TABLE 2

| | SAMPLE NUMBER | | | |
|---|---|---|---|---|
| | 1 | 2 | 3 | 4 |
| Tensile Strength, Lbs. | | | | |
| Warp | 176.6 | 176.8 | 184.3 | 176.9 |
| Weft | 98.3 | 115.9 | 134.2 | 130.2 |
| Elongation | | | | |
| Warp | 22.73 | 22.75 | 23.61 | 22.17 |
| Weft | 22.25 | 28.0 | 32.69 | 22.75 |
| End/Pick Count | | | | |
| Warp | 24.0 | 24.0 | 24.0 | 24.0 |
| Weft | 12.0 | 12.0 | 12.0 | 12.0 |
| Body Weight, oz/yd$^2$ | 3.66 | 3.69 | 3.69 | 3.46 |
| Burst Force, Lbs | 396 | 344 | 354 | 376 |
| Puncture, Lbs. | 103 | 71 | 73 | 71 |
| AOS | 30 | 30 | 30 | 30 |
| % Retained | 99.4 | 99.6 | 100.0 | 100.0 |
| Water Flow, | | | | |
| Gal/min/ft$^2$ | 147 | 147 | 114 | 129 |
| Fabric Width, In. | 24.5 | 36.5 | 24.0 | 24.0 |
| | 5 | 6 | 7 | 8 |
| Tensile Strength, Lbs. | | | | |
| Warp | 165.2 | 158.5 | 162.9 | 188.3 |
| Weft | 102.7 | 103.0 | 115.7 | 111.6 |
| Elongation | | | | |
| Warp | 22.66 | 19.91 | 22.15 | 23.08 |
| Weft | 20.31 | 28.64 | 31.59 | 30.37 |
| End/Pick Count | | | | |
| Warp | 24.0 | 24.0 | 24.6 | 24.0 |
| Weft | 12.0 | 12.0 | 12.0 | 12.0 |
| Body Weight, oz/yd$^2$ | 3.80 | 3.57 | 3.55 | 3.55 |
| Burst Force, Lbs | 388 | 396 | 344 | 320 |
| Puncture, Lbs. | 68 | 78 | 83 | 76 |
| AOS | 30 | 30 | 30 | 30 |
| % Retained | 99.6 | 100.0 | 99.8 | 99.8 |
| Water Flow, | | | | |
| Gal/min/ft$^2$ | 147 | 103 | 103 | 115 |
| Fabric Width, In. | 24.0 | 36.1 | 36.3 | 24.0 |

The test methods used were the methods listed in Table 1 for the measured property.

As can be seen in Table 2, the silt control fabric of the invention has excellent particle retention; all sample fabrics retained in excess of 99.4% of all particles sized larger than 30 AOS. At the same time all samples had surprisingly high water flow capacity. Each had water flow capacity in excess of 90 gal/min/ft$^2$. In addition, each sample had excellent tensile strengths in both the warp and the weft. The fabric properties also did not change with fabric width. The fabrics also were of light weight, with each below 4 ounces per square yard of fabric. Each of the fabrics met the Georgia DOT specifications for soil retention and water flow capacity.

The enhanced water flow properties of the fabric of the invention are further evidenced by comparison to the water flow properties of commercially available silt control fabrics. For example, the aforementioned Amoco Fabrics and Fibers Company Silt Control Fabric Number 1380, made with a tape yarn warp and a spun yarn weft, retains particles sized between 30 to 50 AOS and has 30 gal/min/ft$^2$ water flow capacity, and the aforementioned Amoco Fabrics and Fibers Company Silt Control Fabric 2125, with tape yarns in the warp and the weft, retains particles between 20 to 30 AOS and has 15 gal/min/ft$^2$ water flow capacity. The sample fabrics of the invention each have the capability of more than three times greater water flow capacity with equal or better particle size retention than these commercially available silt control fabrics.

COMPARATIVE EXAMPLE 1

A fabric was produced which used a polypropylene BCF yarn in the fill, instead of the round monofilament yarn, to compare its water flow capacity to that of the fabric of the invention. In the comparative fabric, the end count was 24.7 ends/inch, using the same flat yarns of Examples 1–8, and the fill count was 12.4 picks/inch, using a 2600 denier substantially polypropylene BCF yarn, made from a polypropylene resin having a melt flow rate of 14–16 grams/10 minutes and a density of 0.905 grams/cubic centimeter. The fabric was woven in a plain weave on a Sulzer loom and tested with the same test methods in Examples 1–8. The comparative fabric had a water flow capacity of 74.8 gal/min/ft$^2$, retained 98.6% of particles above 50 AOS and had tensile strength of 166 lbs. (warp) and 93 lbs. (fill). Thus, the fabric of the invention of Examples 1–8, compared to a fabric woven in similar construction employing a BCF yarn instead of the monofilament yarn, had a greater than 37% increase in water flow capacity. (The minimum 37% increase was calculated using the lowest water flow capacity fabric of Examples 1–8, which was 103 gal/min/ft$^2$.) In addition to the water flow capacity improvement, the fabric of the invention is significantly less expensive than the comparative fabric.

COMPARATIVE EXAMPLE 2

A fabric was woven in a plain weave on a Sulzer loom using flat warp yarns and round monofilament yarns made from the same polypropylene resin of the yarns of Examples 1–8. The monofilament yarns were 16 mils diameter and 1150 denier. The flat yarns were 3.2 mils thick and 58 mils wide and 1000 denier. The fabric was constructed with 16 ends per inch across the warp and 12 picks per inch across the weft. The fabric had 92.8% coverage and was not compacted. The water flow capacity and soil retention of the fabric were tested using the methods used in Examples 1–8. The fabric had a water flow capacity of 92 gal/min/ft$^2$ and retained 68.0% of particles larger than 30 AOS.

The comparative fabric was not compacted in the warp, and although it had high water flow capacity, it had much less soil retention, compared to the fabrics of Examples 1–8 having a compacted warp.

Other fabrics of the invention were woven similarly to those of Examples 1–8, with a warp count of about 24, and using pick counts varying from about 11 to about 15. These fabrics all exhibited high water flow capacities and good soil retention.

While the fabric of the invention is described above for use as a silt control fabric, it should be understood that it can be used for other applications involving solid retention and water flow through the fabric, such as filtration. Having thus described our invention, it is further set out in the following claims.

We claim:

1. A silt control fabric capable of soil retention while permitting water flow through the fabric when installed on a land site comprising: a plurality of substantially flat yarns in one direction in a warp interwoven in a plain weave with a plurality of substantially round monofilament yarns located in a weft substantially perpendicular to the direction of the flat yarns, wherein the flat yarns are compacted to about one hundred to about one hundred twenty percent coverage, and wherein the fabric has at least a tensile strength of about 120 pounds in the warp and about 100 pounds in the weft when measured by ASTM D4632 Grab Test Method, has at least an apparent opening size of about 30 sieve when measured by ASTM D4751 and has at least a water flow rate capacity through the fabric of about 90 gallons per minute per square foot of fabric.

2. A method for preventing soil or sand run-off from a land site comprising: installing on the land site an apparatus comprising (a) a woven synthetic fabric having a plurality of substantially flat yarns in one direction interwoven with a plurality of substantially round monofilament yarns located in a direction substantially perpendicular to the direction of the flat yarns, wherein the flat yarns are compacted to about one hundred to about one hundred twenty percent coverage, and wherein the fabric has at least a tensile strength of about 120 pounds in the warp and about 100 pounds in the weft when measured by ASTM D4632 Grab Test Method, has at least an apparent opening size of about 30 sieve when measured by ASTM D4751 and has at least a water flow rate capacity through the fabric of about 90 gallons per minute per square foot of fabric, (b) support means, and (c) attachment means for attaching the fabric to the support means.

3. The method of claim 2 wherein the apparatus is installed substantially perpendicular to the land site.

4. The method of claim 2 wherein the fabric has water flow rate capacity through the fabric of at least 90 gallons per minute per square foot of fabric.

5. The method of claim 3 wherein the apparatus is installed in a trench in the earth.

* * * * *